US007761027B2

(12) United States Patent
Takami

(10) Patent No.: US 7,761,027 B2
(45) Date of Patent: Jul. 20, 2010

(54) PROCESS CARTRIDGE FOR IMAGE-FORMING DEVICE

(75) Inventor: Takeshi Takami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 953 days.

(21) Appl. No.: 11/311,414

(22) Filed: Dec. 20, 2005

(65) Prior Publication Data

US 2006/0140664 A1 Jun. 29, 2006

(30) Foreign Application Priority Data

Dec. 24, 2004 (JP) ..... 2004-374680

(51) Int. Cl.
*G03G 15/02* (2006.01)
*G03G 21/18* (2006.01)

(52) U.S. Cl. ..... 399/100; 399/113; 399/111; 399/119

(58) Field of Classification Search ..... 399/100, 399/113
See application file for complete search history.

(56) References Cited

U.S. PATENT DOCUMENTS 5,194,897 A * 3/1993 Yoshiyama et al. ..... 399/100
5,351,728 A * 10/1994 Ban et al. ..... 141/364
2004/0062565 A1 * 4/2004 Itabashi ..... 399/100

FOREIGN PATENT DOCUMENTS

JP A 10-301368 11/1998
JP A 11-133834 5/1999
JP A 2001-222153 8/2001

* cited by examiner

*Primary Examiner*—David P Porta
*Assistant Examiner*—Bryan P Ready
(74) *Attorney, Agent, or Firm*—Oliff & Berridge, PLC

(57) ABSTRACT

A charger has a charging wire that extends in the axial direction and that has one end and another end. The charger is configured to charge the image-bearing member. A cleaning member is movable in the axial direction for cleaning the charging wire. The cleaning member is movable between a first position located on the one end and a second position located on the another end. A removal-restricting portion is movable between the first position and the second position. A developer cartridge is detachably mounted on the image-bearing member cartridge. The removal-restricting portion prevents the developer cartridge from being removed from the image-bearing member cartridge when the cleaning member is in the first position, and allows the developer cartridge to be removed from the image-bearing member cartridge when the cleaning member is in the second position.

14 Claims, 9 Drawing Sheets

PROCESS CARTRIDGE FOR IMAGE-FORMING DEVICE

CROSS REFERENCE TO RELATED APPLICATION

This application claims priority from Japanese Patent Application No. 2004-374680, filed Dec. 24, 2004, the entire subject matter of which is incorporated herein by reference.

TECHNICAL FIELD

The present invention relates to a process cartridge, an image-bearing member cartridge and a developer cartridge provided in the process cartridge, and an image-forming device equipped with the process cartridge.

BACKGROUND

Conventional image-forming devices, such as laser printers, have been provided with a main device body in which a process cartridge can be detachably mounted to facilitate replacement of a photosensitive drum, toner, and the like.

The process cartridge is configured of a photosensitive member cartridge, including a photosensitive drum, and a toner cartridge that accommodates toner. The photosensitive member cartridge and toner cartridge are removed together from the main device body as the process cartridge, after which the two cartridges can be separated and replaced individually.

Generally, the photosensitive member cartridge is provided with a charger for charging the surface of the photosensitive drum. Often, a Scorotron charger is used for charging the photosensitive drum by applying a high voltage to a charging wire stretched tightly in the axial direction of the photosensitive drum to produce a corona discharge. In this type of image-forming device using a Scorotron charger, silica and other substances in the toner become deposited on the surface of the charging wire after image forming operations are repeatedly performed. A buildup of deposited matter on the charging wire can degrade the charging performance of the wire, causing problems in printing. Japanese patent application publication No. HEI-10-301368 discloses a cleaning member, which is often disposed in the photosensitive member cartridge so as to be moved along the charging wire. By operating the cleaning member, the user can remove matter deposited on the charging wire.

SUMMARY

Since the operation for cleaning the charging wire described above must be performed periodically, a label is generally attached to the process cartridge for urging the user to perform this cleaning operation each time the toner cartridge is replaced. However, the user sometimes overlooks this message and does not perform the cleaning operation periodically.

In view of the above-described drawbacks, it is an objective of one aspect of the invention to provide a process cartridge, image-bearing member cartridge, developer cartridge, and image-forming device configured to ensure that the user periodically performs the cleaning operation to clean the charging wire.

In order to attain the above and other objects, one aspect of the present invention provides a process cartridge. The process cartridge includes an image-bearing member cartridge and a developer cartridge. The image-bearing member cartridge includes an image-bearing member, a charger, a cleaning member, and a removal-restricting portion. The image-bearing member extends in an axial direction for bearing a developer image. The charger is disposed adjacent to the image-bearing member. The charger has a charging wire that extends in the axial direction and that has one end and another end. The charger is configured to charge the image-bearing member when a voltage is applied to the charging wire. The cleaning member is movable in the axial direction along the charging wire for cleaning the charging wire. The cleaning member is movable between a first position located on the one end and a second position located on the another end. The removal-restricting portion is movable together with the cleaning member between the first position and the second position. The developer cartridge is detachably mounted on the image-bearing member cartridge and accommodates developer for supplying the image-bearing member with the developer. The removal-restricting portion prevents the developer cartridge from being removed from the image-bearing member cartridge when the cleaning member is in the first position, and allows the developer cartridge to be removed from the image-bearing member cartridge when the cleaning member is in the second position.

According to another aspect, the present invention may provide a image-bearing member cartridge. The image-bearing member cartridge is configured to detachably mount a developer cartridge which accommodates developer. The image-bearing member cartridge includes an image-bearing member, a charger, a cleaning member, and a removal-restricting portion. The image-bearing member extends in an axial direction for bearing a developer image. The charger is disposed adjacent to the image-bearing member. The charger has a charging wire that extends in the axial direction and that has one end and another end. The charger is configured to charge the image-bearing member when a voltage is applied to the charging wire. The cleaning member is movable in the axial direction along the charging wire for cleaning the charging wire. The cleaning member is movable between a first position located on the one end and a second position located on the another end. The removal-restricting portion is movable together with the cleaning member between the first position and the second position. The removal-restricting portion prevents the developer cartridge from being removed from the image-bearing member cartridge when the cleaning member is in the first position, and allows the developer cartridge to be removed from the image-bearing member cartridge when the cleaning member is in the second position.

According to another aspect, the present invention may provide a developer cartridge. The developer cartridge is detachably mountable on an image-bearing member cartridge and accommodates developer. The image-bearing member cartridge includes an image-bearing member, a charger, a cleaning member, a removal-restricting portion. The image-bearing member extends in an axial direction for bearing a developer image. The charger is disposed adjacent to the image-bearing member. The charger has a charging wire that extends in the axial direction and that has one end and another end. The charger is configured to charge the image-bearing member when a voltage is applied to the charging wire. The cleaning member is movable in the axial direction along the charging wire for cleaning the charging wire. The cleaning member is movable between a first position located on the one end and a second position located on the another end. The removal-restricting portion is movable together with the cleaning member between the first position and the second position. The removal-restricting portion includes a restricting member. The restricting member extends in an extending direction from the cleaning member toward a mounting section for mounting the developer cartridge. The restricting member is movable together with the cleaning member. The developer cartridge includes an engaging part. The engaging part engages with the restricting member for preventing the developer cartridge from being removed from the image-bearing member cartridge when the cleaning member is in a position other than the second position, and is disengaged from the restricting member for allowing the developer cartridge to be removed from the image-bearing member cartridge when the cleaning member is in the second position.

According to another aspect, the present invention may provide a image-forming device. The image-forming device includes a main body, a cartridge-accommodating section, a process cartridge, and an interference member. The cartridge-accommodating section is provided in the main body. The process cartridge is detachably accommodated in the cartridge-accommodating section. The process cartridge includes an image-bearing member cartridge and a developer cartridge. The image-bearing member cartridge includes an image-bearing member, a charger, a cleaning member, and a removal-restricting portion. The image-bearing member extends in an axial direction for bearing a developer image. The charger is disposed adjacent to the image-bearing member. The charger has a charging wire that extends in the axial direction and that has one end and another end. The charger is configured to charge the image-bearing member when a voltage is applied to the charging wire. The cleaning member is movable in the axial direction along the charging wire for cleaning the charging wire. The cleaning member is movable between a first position located on the one end and a second position on the another end. The removal-restricting portion is movable together with the cleaning member between the first position and the second position. The developer cartridge is detachably mounted on the image-bearing member cartridge and accommodates developer for supplying the image-bearing member with the developer. The interference member is disposed in the cartridge accommodating section and is formed with an opening at a position corresponding to the first position. At least one of the cleaning member and the removal-restricting portion includes a protruding part that protrudes in a direction away from the image-bearing member cartridge, thereby allowing the cleaning member to be movably operated. When the protruding part is in the first position, the interfering member allows the protruding part to pass through the opening, thereby enabling the process cartridge to be mounted in the cartridge-accommodating section. When the protruding part is in a position other than the first position, the interfering member interferes with the protruding part, thereby preventing the process cartridge from being mounted in the cartridge-accommodating section.

According to another aspect, the present invention may provide a image-forming device. The image-forming device includes a main body, a cartridge-accommodating section, a process cartridge, and a guide member. The cartridge-accommodating section is provided in the main body. The process cartridge is detachably accommodated in the cartridge-accommodating section. The process cartridge includes an image-bearing member cartridge, a developer cartridge. The image-bearing member cartridge includes an image-bearing member, a charger, a cleaning member, and a removal-restricting portion. The image-bearing member extends in an axial direction for bearing a developer image. The charger is disposed adjacent to the image-bearing member. The charger has a charging wire that extends in the axial direction and that has one end and another end. The charger is configured to charge the image-bearing member when a voltage is applied to the charging wire. The cleaning member is movable in the axial direction along the charging wire for cleaning the charging wire. The cleaning member being movable between a first position located on the one end and a second position located on the another end. The removal-restricting portion is movable together with the cleaning member between the first position and the second position. The developer cartridge is detachably mounted on the image-bearing member cartridge and accommodates developer for supplying the image-bearing member with the developer. The guide member disposed in the cartridge accommodating section. At least one of the cleaning member and the removal-restricting portion includes a protruding part that protrudes in a direction away from the image-bearing member cartridge, thereby allowing the cleaning member to be movably operated. The guide member guides the protruding part to the first position when the process cartridge is being mounted in the cartridge-accommodating section, when the protruding part is in a position other than the first position.

According to another aspect, the present invention may provide a developer cartridge. The developer cartridge is detachably mountable on an image-bearing member cartridge. The image-bearing member cartridge includes an image-bearing member, a charger, and a restricting member. The image-bearing member extends in an axial direction for bearing a developer image. The charger has a charging wire that extends in the axial direction and that has one end and another end. The restricting member is movable in the axial direction along the charging wire between a first position located on the one end and a second position located on the another end. The restricting member is configured to engage with the developer cartridge, when the developer cartridge is mounted on the image-bearing member cartridge. The shape of the developer cartridge is formed such that an engagement state between the restricting member and the developer cartridge in the first position is different from an engagement state between the restricting member and the developer cartridge in the second position.

BRIEF DESCRIPTION OF THE DRAWINGS

The above and other objects, features and advantages of the invention will become more apparent from reading the following description taken in connection with the accompanying drawings in which:

FIG. 1 is a side cross-sectional view of a laser printer according to illustrative aspects of the.

DETAILED DESCRIPTION

An image-forming device according to illustrative aspects of the invention will be described with reference to FIGS. 1 through 6.

1. General Structure of the Image-Forming Device

Figure 1:
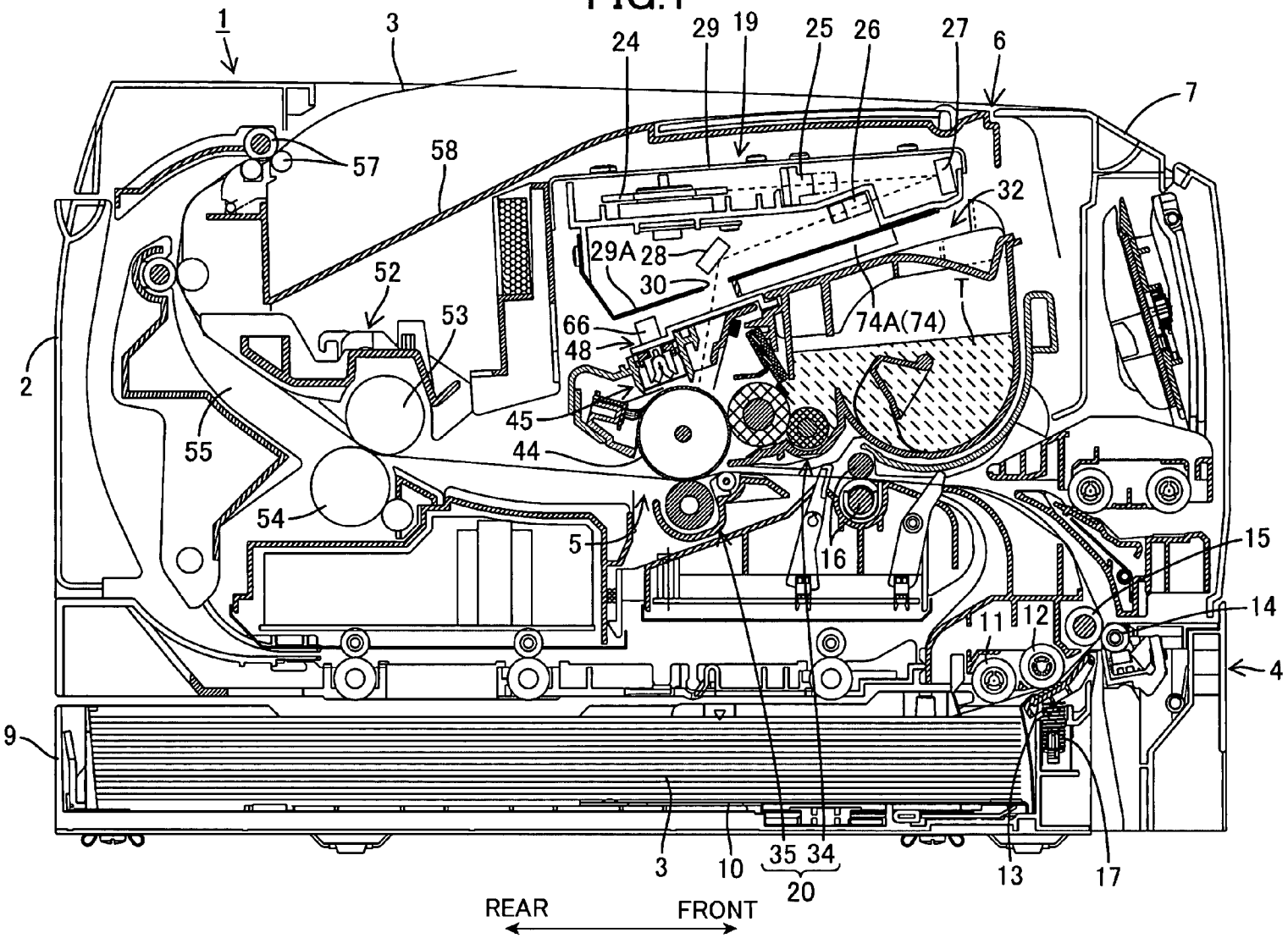

FIG. 1 is a side cross-sectional view of a laser printer 1 serving as the image-forming device according to illustrative aspects of the invention. In the following description, the right side of the laser printer 1 in FIG. 1 will be referred to as the "front side" and the left side as the "rear side." As shown in FIG. 1, the laser printer 1 includes a main casing 2 and, within the main casing 2, a feeding unit 4 for supplying sheets of a paper 3, an image-forming unit 5 for forming images on the paper 3 supplied from the feeding unit 4, and the like.

(1) Main Casing

An access opening 6 is formed in the front surface of the main casing 2 for inserting and removing a process cartridge 20 described later. A front cover 7 is disposed on the front surface of the main casing 2 and is capable of opening and closing over the access opening 6. The front cover 7 is rotatably supported by a cover shaft (not shown) inserted through a bottom end of the front cover 7. When the front cover 7 is rotated closed about the cover shaft, the front cover 7 covers the access opening 6, as shown in FIG. 1. When the front cover 7 is rotated open about the cover shaft (rotated downward), the access opening 6 is exposed, enabling the process cartridge 20 to be mounted into or removed from the main casing 2 via the access opening 6.

(2) Feeding Unit

The feeding unit 4 includes a paper cassette 9, a paper-pressing plate 10 disposed in the paper cassette 9, a pickup roller 11 disposed above the front end of the paper cassette 9, a feeding roller 12 and separating pad 13, a paper dust roller 14, a pinch roller 15 disposed in confrontation with the paper dust roller 14, and a pair of registration rollers 16 disposed downstream of the paper dust roller 14 in a conveying direction of the paper 3.

The paper cassette 9 is detachably mounted in a lower section of the main casing 2 and functions to accommodate stacked sheets of the paper 3. The paper cassette 9 is pulled out of the laser printer 1 through the front side of the main casing 2 (right side in FIG. 1) in order to load the paper 3 therein.

The paper-pressing plate 10 is pivotably supported on the end farthest from the feeding roller 12 so that the end nearest the feeding roller 12 can move vertically. A spring (not shown) is disposed on the underside of the paper-pressing plate 10 for urging the front end of the paper-pressing plate 10 upward. As the number of sheets of paper 3 stacked on the paper-pressing plate 10 increases, the end of the paper-pressing plate 10 nearest the feeding roller 12 moves downward against the urging force of the spring about a point on the end farthest from the feeding roller 12.

The pickup roller 11 is positioned so as to contact the topmost sheet of the paper 3 among the sheets stacked on the paper-pressing plate 10 in the paper cassette 9. The pickup roller 11 conveys the topmost sheet of paper 3 to a position from which the paper 3 can be conveyed by the feeding roller 12 (the contact point between the feeding roller 12 and separating pad 13).

The separating, pad 13 is disposed at a position opposing the feeding roller 12. A spring 17 disposed on the underside of the separating pad 13 presses the separating pad 13 against the feeding roller 12. The separating pad 13 functions to prevent a plurality of sheets of the paper 3 from being supplied along the paper-conveying path in an overlapped state. Hence, the pickup roller 11 conveys the sheet of paper 3 until the sheet contacts the feeding roller 12 and separating pad 13. At this time, the separating pad 13 applies an appropriate frictional force to the paper 3 and stops all sheets of the paper 3 except the topmost sheet when the pickup roller 11 conveys a plurality of sheets to the separating pad 13. Accordingly, the feeding roller 12 can supply the paper 3 one sheet at a time. The feeding roller 12 conveys the sheet of paper 3 to the registration rollers 16 along a path that doubles back toward the rear of the laser printer 1 at a position near the front end of the paper cassette 9. During this time, the paper dust roller 14 removes paper dust from the paper 3.

The registration rollers 16 register the paper 3 and subsequently convey the paper 3 to a transfer position between a photosensitive drum 44 and a transfer roller 46 (see FIG. 2) described later. The transfer position is the position at which a toner image carried on the photosensitive drum 44 is transferred onto the paper 3.

(3) Image-Forming Unit

The image-forming unit 5 includes a scanning unit 19, the process cartridge 20, and a fixing unit 52.

(a) Scanning Unit

The scanning unit 19 is disposed in an upper section of the main casing 2 and includes a laser light-emitting unit (not shown), a polygon mirror 24 that can be driven to rotate, lenses 25 and 26, and reflecting mirrors 27 and 28. These components are accommodated in a scanner case 29. In the scanning unit 19 having this construction, a laser beam is emitted from the laser light-emitting unit based on prescribed image data and, as indicated by a dotted line in FIG. 1, sequentially passes through or reflects off the polygon mirror 24, lens 25, reflecting mirror 27, lens 26, and reflecting mirror 28 in the order given. The scanner case 29 also has a bottom wall 29A in which is provided an output window 30. The laser beam is irradiated through the output window 30 to expose the surface of the photosensitive drum 44 in the process cartridge 20 in a high-speed scan.

(b) Process Cartridge

Figure 2:
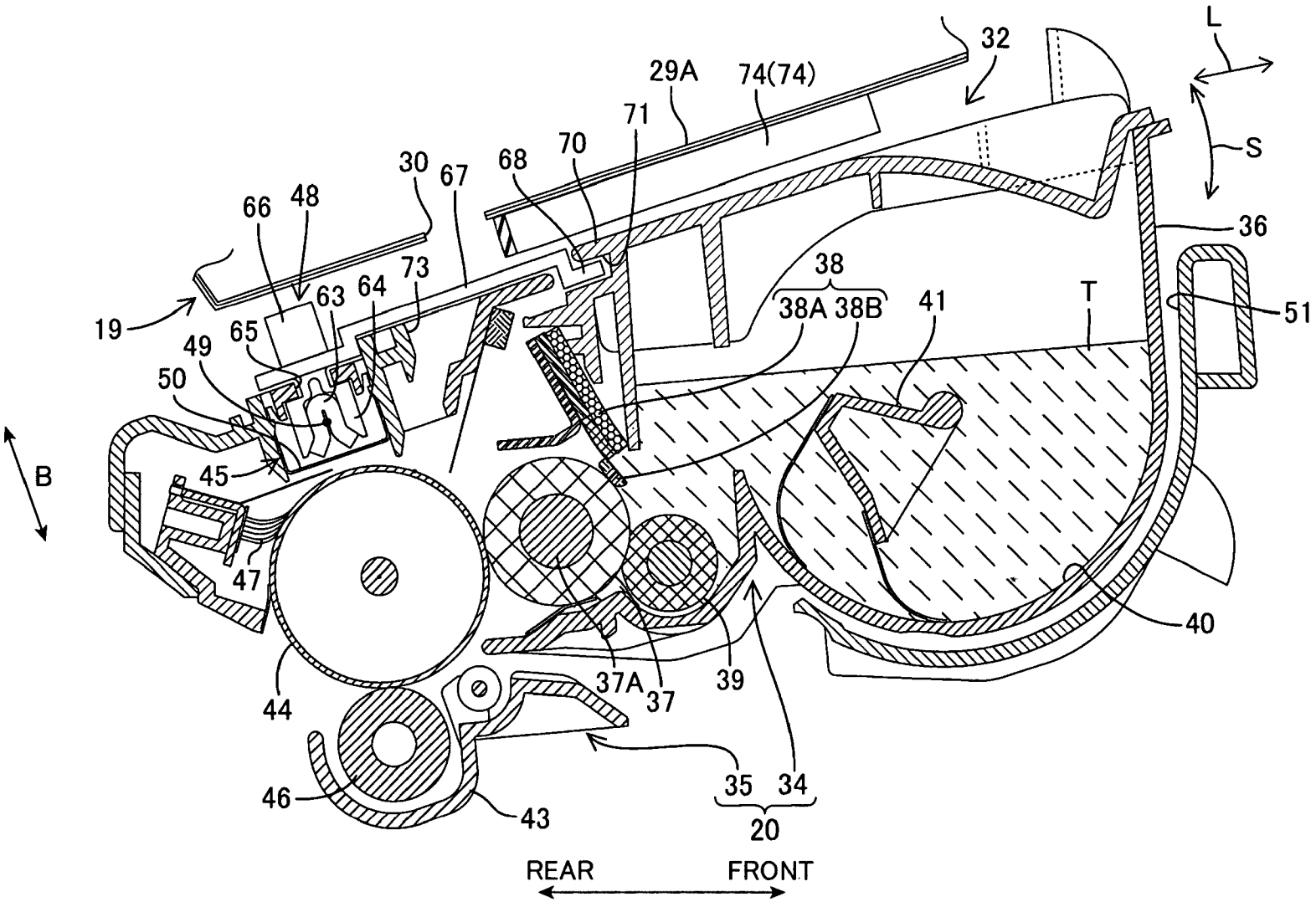
FIG. 2 is a side cross-sectional view showing a process cartridge mounted in the laser printer, and the bottom wall of a scanning unit.

A cartridge-accommodating section 32 is formed in the main casing 2 below the scanning unit 19 and is in communication with the access opening 6. The process cartridge 20 is detachably mounted in the cartridge-accommodating section 32. FIG. 2 is a side cross-sectional view of the process cartridge 20 and the bottom wall 29A of the scanning unit 19. As shown in FIG. 2, the process cartridge 20 includes a toner cartridge 34, and a drum cartridge 35.

The toner cartridge 34 is detachably mounted on the drum cartridge 35. The toner cartridge 34 includes a toner case 36 formed in a box shape that is open on the rear side, and within the toner case 36, a developing roller 37, a thickness-regulating blade 38, a supply roller 39, and the like.

A toner-accommodating chamber 40 is provided in a front section of the toner case 36 for accommodating a toner T. An agitator 41 is rotatably provided in the toner-accommodating chamber 40 for agitating the toner T. The supply roller 39 is rotatably provided to the rear side of the toner-accommodating chamber 40. The developing roller 37 is rotatably disposed in confrontation with the supply roller 39. The supply roller 39 and developing roller 37 contact each other with pressure so that each is compressed to a degree.

The supply roller 39 is configured of a metal roller shaft covered by a roller that is formed of an electrically conductive foam material. The developing roller 37 is configured of a metal roller shaft 37A covered by a roller that is formed of an electrically conductive rubber material having no magnetic properties. More specifically, the roller portion of the developing roller 37 is formed of an electrically conductive urethane rubber or silicone rubber including fine carbon particles or the like, the surface of which is coated with a urethane rubber or silicone rubber including fluorine. During a developing operation, a developing bias is applied to the developing roller 37.

The thickness-regulating blade 38 is disposed near the developing roller 37. The thickness-regulating blade 38 is configured of a main blade member 38A formed of a metal leaf spring member, and a pressing part 38B provided on the distal end of the main blade member 38A. The pressing part 38B has a semicircular cross section and is formed of an insulating silicone rubber. The thickness-regulating blade 38 is supported on the toner cartridge 34 near the developing roller 37 so that the elastic force of the main blade member 38A causes the pressing part 38B to contact the developing roller 37 with pressure.

Toner discharged from the toner-accommodating chamber 40 is supplied onto the developing roller 37 by the rotation of the supply roller 39. At this time, the toner is positively tribocharged between the supply roller 39 and developing roller 37. As the developing roller 37 continues to rotate, the toner supplied onto the surface of the developing roller 37 passes between the pressing part 38B of the thickness-regulating blade 38 and the developing roller 37, at which time the toner is further tribocharged and is smoothed so that a thin layer of uniform thickness is carried on the developing roller 37.

The drum cartridge 35 includes a cartridge 35 frame 43 as an outer casing, the photosensitive drum 44, a Scorotron charger 45, the transfer roller 46, a cleaning brush 47, and a cleaning member 48.

The cartridge frame 43 has an overall box shape. The cartridge frame 43 includes a mounting section 51, in approximately the front half of the cartridge frame 43, that is open on the top side. The toner cartridge 34 described above is detachably mounted in the mounting section 51.

The photosensitive drum 44 is cylindrical in shape and is configured of a metal drum shaft covered with a main drum body. The main drum body is formed of a positive charging photosensitive layer of polycarbonate or the like on the outermost layer. The photosensitive drum 44 is capable of rotating about the drum shaft, which is supported on the cartridge frame 43 and is oriented in the left-to-right direction.

The charger 45 is disposed in opposition to the photosensitive drum 44 from a position diagonally above and rearward of the same and is separated a prescribed distance from the photosensitive drum 44. The charger 45 includes a charging wire 49 stretched along the axis of the photosensitive drum 44, and a grid 50 disposed between the charging wire 49 and the photosensitive drum 44 for controlling the amount of discharge from the charging wire 49 applied to the photosensitive drum 44. The charger 45 produces a corona discharge with the charging wire 49 by applying a high voltage to the same, at the same time a bias voltage is applied to the grid 50, in order to charge the surface of the photosensitive drum 44 with a uniform positive polarity. As will be described in greater detail below. The cleaning member 48 is disposed near the charger 45 for cleaning the surface of the charging wire 49.

The cleaning brush 47 is disposed to the rear side of the photosensitive drum 44 so as to contact the surface of the same.

The transfer roller 46 is disposed below the photosensitive drum 44 and in opposition thereto, and is supported on the cartridge frame 43 so as to be capable of rotating in the counterclockwise direction of FIG. 2. The transfer roller 46 includes a metal roller shaft covered by a roller that is formed of a rubber material with ionic conductivity. A forward bias is applied to the transfer roller 46 during a transfer operation.

As the photosensitive drum 44 rotates, the charger 45 charges the surface of the photosensitive drum 44 with a uniform positive polarity. Subsequently, the scanning unit 19 irradiates a laser beam in a high-speed scan, while turning the beam on and off based on image data inputted from an external source, to form an electrostatic latent image on the surface of the photosensitive drum 44 based on the prescribed image data.

Next, positively charged toner carried on the surface of the developing roller 37 comes into contact with the photosensitive drum 44 as the developing roller 37 rotates and is supplied to areas on the surface of the positively charged photosensitive drum 44 that were exposed to the laser beam and, therefore, have a lower potential. In this way, the latent image on the photosensitive drum 44 is developed into a visible image according to a reverse development process.

Subsequently, as the registration rollers 16 convey a sheet of the paper 3 through the transfer position between the photosensitive drum 44 and transfer roller 46, the toner image carried on the surface of the photosensitive drum 44 is transferred onto the paper 3 by the transfer bias applied to the transfer roller 46. After the toner image is transferred, the paper 3 is conveyed to the fixing unit 52.

Toner remaining on the photosensitive drum 44 after the transfer operation is recovered by the developing roller 37. Further, paper dust deposited on the photosensitive drum 44 from the paper 3 is recovered by the cleaning brush 47 after the transfer operation.

(c) Fixing Unit

The fixing unit 52 is disposed on the rear side of the process cartridge 20 and includes a heating roller 53, and a pressure roller 54.

The heating roller 53 includes a metal tube, the surface of which has been coated with a fluorine resin, and a halogen lamp disposed inside the metal tube for heating the same. The heating roller 53 is driven to rotate by a driving force inputted from a motor (not shown). The pressure roller 54 is disposed below and in opposition to the heating roller 53 and contacts the heating roller 53 with pressure. The pressure roller 54 is configured of a metal roller shaft covered with a roller that is formed of a rubber material. The pressure roller 54 follows the rotational drive of the heating roller 53.

In the fixing unit 52, toner transferred onto the paper 3 at the transfer position is fixed to the paper 3 by heat as the paper 3 passes between the heating roller 53 and pressure roller 54. After the toner is fixed to the paper 3, the heating roller 53 and pressure roller 54 convey the paper 3 along a discharge path 55 that leads upward toward the top surface of the main casing 2. Discharge rollers 57 provided at the top of the discharge path 55 receive the paper 3 conveyed along the discharge path 55 and discharge the paper 3 onto a discharge tray 58 formed on the top surface of the main casing 2.

(4) Locking Configuration of the Cleaning Member and the Toner Cartridge

Figure 3:
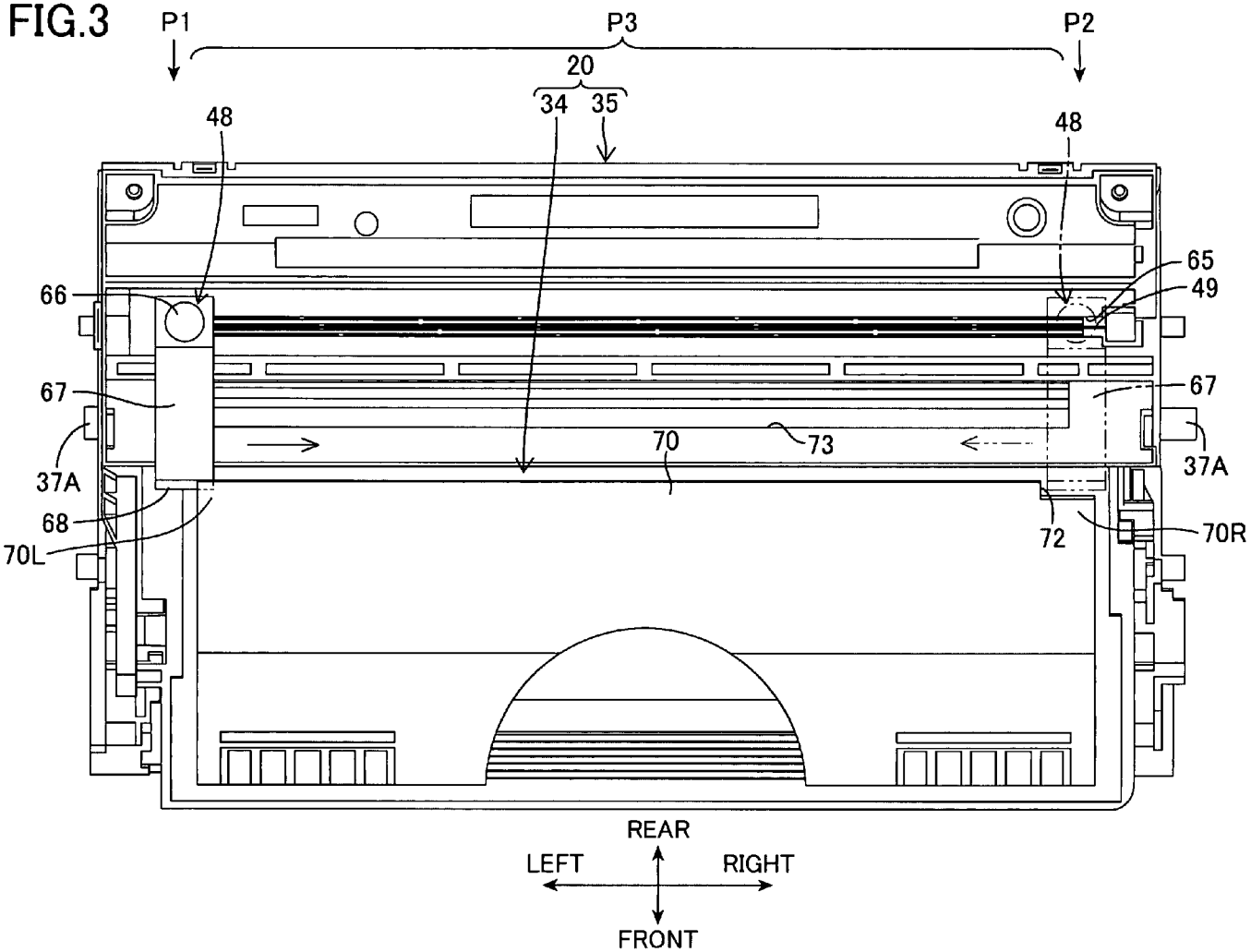
FIG. 3 is a plan view of the process cartridge.
Figure 4:
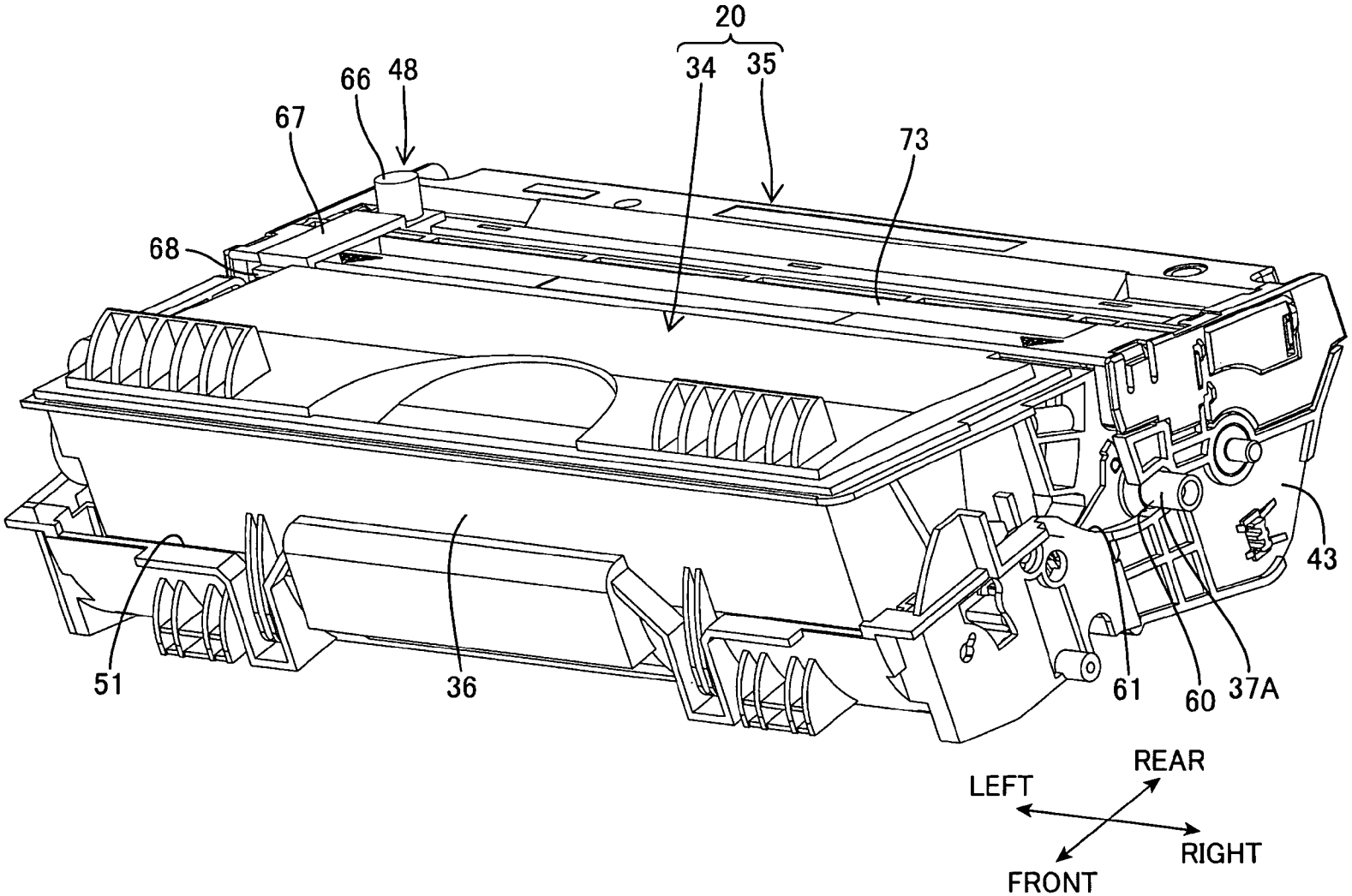
FIG. 4 is a perspective view of the process cartridge.
Figure 5:
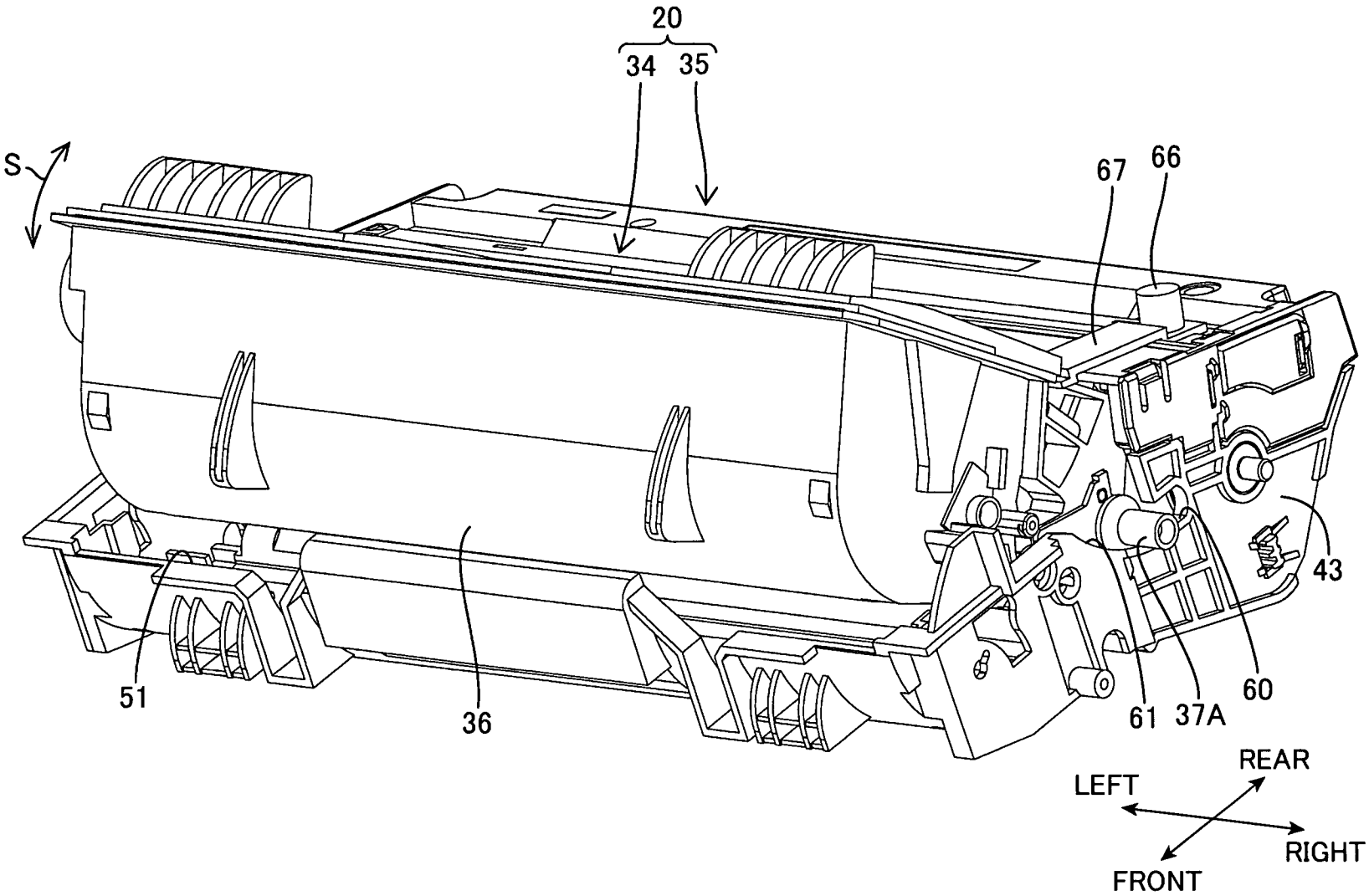
FIG. 5 is a perspective view illustrating the process for mounting a toner cartridge on or removing the toner cartridge from a photosensitive member cartridge.

FIG. 3 is a plan view of the process cartridge 20. FIG. 4 is a perspective view of the process cartridge 20. FIG. 5 is a perspective view illustrating the process of mounting the toner cartridge 34 on or removing the toner cartridge 34 from the drum cartridge 35.

As shown in FIG. 4, the metal roller shaft 37A of the developing roller 37 described above protrudes outward from both left and right side surfaces of the toner cartridge 34 near the rear edge thereof. Guide grooves 60 are provided in both left and right side walls of the cartridge frame 43 at positions corresponding to the rear edge region of the mounting section 51 and are open on the front side. When the toner cartridge 34 is mounted on the drum cartridge 35, the toner cartridge 34 is guided into a proper position with respect to the drum cartridge 35, as shown in FIG. 4, by guiding the metal roller shaft 37A into the guide grooves 60. Substantially arc-shaped guide edges 61 are formed continuously from lower edges of the guide grooves 60 in both side walls of the cartridge frame 43. By sliding the metal roller shaft 37A along the guide edges 61 when mounting the toner cartridge 34, the toner cartridge 34 is guided to move in the direction indicated by an arrow S in FIGS. 2 and 5.

As shown in FIG. 2, the cleaning member 48 includes an elastic sponge member 63, and a retaining member 64 for holding the sponge member 63 around the charging wire 49 so that the charging wire 49 is pinched by the sponge member 63. A groove 65 is formed in the top surface of the cartridge frame 43 above the charging wire 49 and extending over substantially the entire length of the charging wire 49. The retaining member 64 is mounted in the edge portion of the groove 65 and is capable of sliding in the longitudinal direction of the groove 65 (axial direction of the photosensitive drum 44). A columnar protruding part 66 is integrally provided on the top surface of the cleaning member 48 protruding upward. The top surfaces of the cartridge frame 43 and toner case 36 are substantially flush with each other when the toner cartridge 34 is mounted on the drum cartridge 35, but the protruding part 66 protrudes farther upward from this surface. By gripping the protruding part 66 and sliding the cleaning member 48 left and right, the user can slide the sponge member 63 over the charging wire 49 to remove matter deposited on the charging wire 49.

A restricting member 67 is integrally provided on the top portion of the cleaning member 48. The restricting member 67 is substantially planar in shape and extends from the cleaning member 48 across the top surface of the cartridge frame 43. A front end portion of the restricting member 67 is formed as a lower step part. The lower portion of this step part serves as a fitting part 68 that protrudes toward the upper rear edge of the toner cartridge 34. A engaging part 70 extending in the left-to-right direction of the toner cartridge 34 is formed on the upper rear edge of the toner case 36. The engaging part 70 has a box-like cross section that is open on the rear side so that a groove 71 is formed in the rear of the engaging part 70 in the left-to-right direction. The fitting part 68 is capable of fitting inside the groove 71. Further, as shown in FIG. 3, a cutout part 72 is formed in the right edge of the engaging part 70. The right side of the cutout part 72, a right edge 70R is formed such that As shown in FIG. 3, the cleaning member 48 can slide on an intermediate position P3 between a lock position P1 on the left edge of the charging wire 49, indicated by solid lines, and a release position P2 on the right edge of the charging wire 49, indicated by a dotted line. When the cleaning member 48 is in the lock position P1, the sponge member 63 is disposed on the charging wire 49 at a position outside the area corresponding to the image-forming region on which a laser beam outputted from the scanning unit 19 scans, that is, to the left of the image-forming region. Hence, the cleaning member 48 does not interfere with charging of the photosensitive drum 44 and, hence, does not adversely affect image formation. When the cleaning member 48 is on the left side of the release position P2 (that is, in the lock position P1 or in the intermediate position P3) the fitting part 68 is fitted in the groove 71 so that the restricting member 67 is engaged with the engaging part 70, thereby restricting removal of the toner cartridge 34. Further, when the cleaning member 48 is in the release position P2, the fitting part 68 is separated from the groove 71 at a position corresponding to the cutout part 72 (FIG. 3). Hence, the restricting member 67 is no longer engaged with the engaging part 70. Accordingly, the toner cartridge 34 can be mounted on or removed from the drum cartridge 35 only when the cleaning member 48 is in the release position P2. In this way, the toner cartridge 34 is engaged with the engaging part 70 and is prevented from being removed from the drum cartridge 35 when the cleaning member 48 is in the lock position P1 and the intermediate position P3. In other words, a left edge 70L of the engaging part 70 engages with the fitting part 68 when the cleaning member is in the lock position P1. A right edge 70R of the engaging part 70 releases the fitting part 68 when the cleaning member is in the release position P2. This way, the shape of the toner cartridge 34 is formed such that an engagement state between the restricting member 67 and the toner cartridge 34 in the lock position P1 is different from an engagement state between the restricting member 67 and the toner cartridge 34 in the release position P2.

As shown in FIGS. 2 and 3, an input window 73 is formed in the top surface of the cartridge frame 43 between the path of the cleaning member 48 and the toner cartridge 34 (mounting section 51). The input window 73 allows passage of a laser beam outputted from the scanning unit 19 via the output window 30 to irradiate the photosensitive drum 44. The input window 73 extends in the left-to-right direction at a position corresponding to the output window 30. When the cleaning member 48 is in the release position P2 or the intermediate position P3, the restricting member 67 partially blocks the input window 73. When the cleaning member 48 is in the lock position P1, the restricting member 67 is positioned outside of the input window 73 in the left-to-right direction and, hence, does not obstruct the laser beam.

Figure 6:
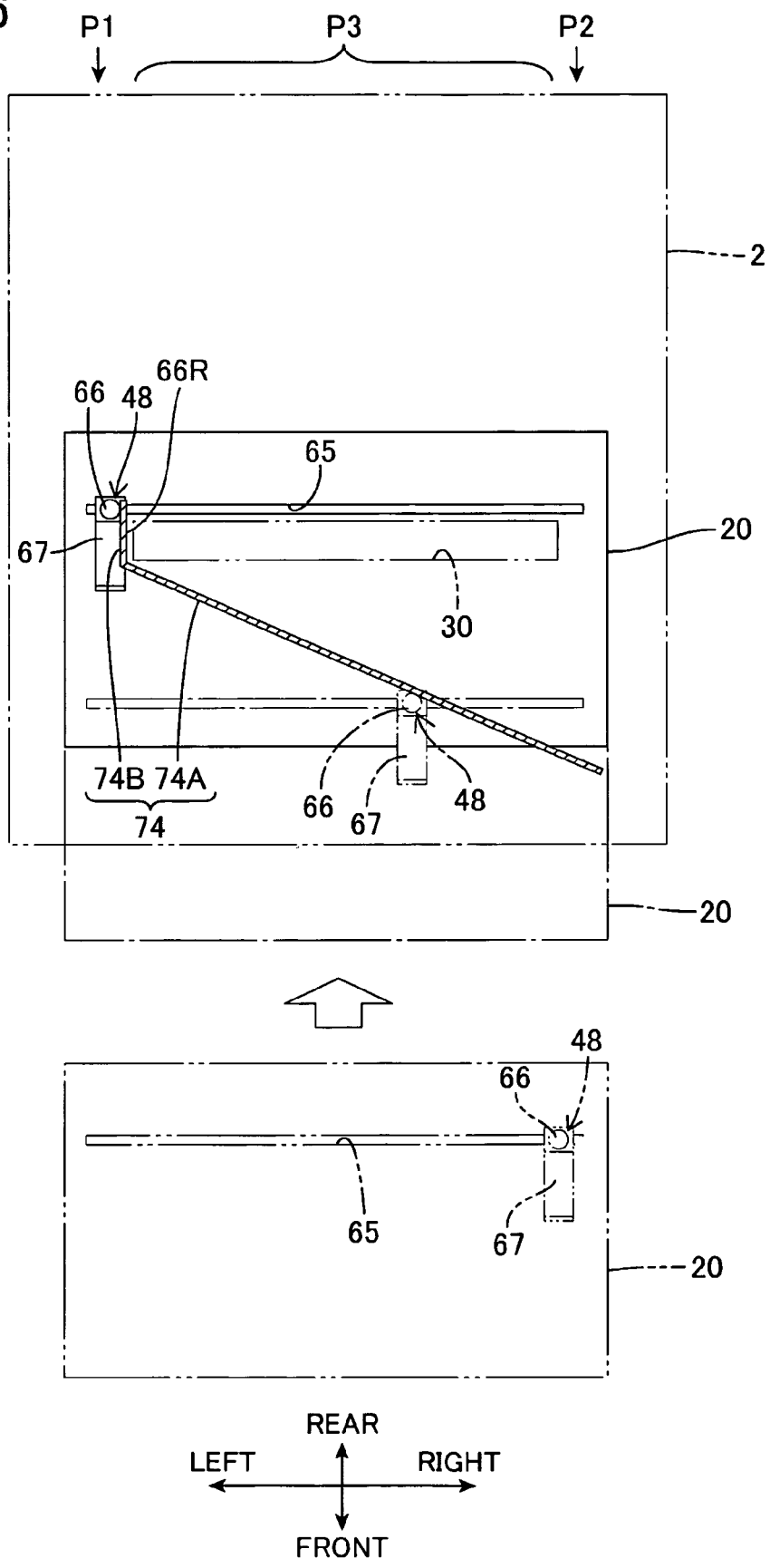
FIG. 6 is an explanatory diagram illustrating the function of a guiding member for guiding a cleaning member when the process cartridge is inserted into the laser printer.

The process cartridge 20 is inserted into the cartridge-accommodating section 32 through the access opening 6 (FIG. 1) in a downward sloping direction, and is removed in the opposite direction, as indicated by the arrow L in FIG. 2. The bottom wall 29A of the scanner case 29 formed at the ceiling portion of the cartridge-accommodating section 32 is substantially parallel to the mounting and removing direction of the process cartridge 20. As shown in FIGS. 1 and 2, a guiding member 74 is formed on the bottom wall 29A of the scanner case 29 protruding downward for guiding the protruding part 66 of the cleaning member 48. FIG. 6 is an explanatory diagram illustrating the function of the guiding member 74 for guiding the cleaning member 48 when mounting the process cartridge 20.

As shown in FIG. 6, the guiding member 74 includes a sloped part 74A, and a parallel part 74B. The sloped part 74A slopes rearward from right to left when viewed from the front. The parallel part 74B extends rearward from the left edge of the sloped part 74A. The sloped part 74A is disposed to the front of the output window 30, while the parallel part 74B is positioned on the left side of the output window 30, so that neither is in a position to interfere with the output window 30. Further, the right edge of the sloped part 74A extends farther right than the position of the protruding part 66 when the cleaning member 48 is in the release position P2. The left edge of the sloped part 74A and the left surface of the parallel part 74B are formed substantially flush with the right surface 66R of the protruding part 66 when the cleaning member 48 is in the lock position P1. Accordingly, when mounting the process cartridge 20 in the cartridge-accommodating section 32, if the cleaning member 48 is to the right of the lock position P1, the guiding member 74 guides the protruding part 66 into the lock position P1.

Operations and Effects

As shown in FIGS. 2 and 3, when performing image formation with the laser printer 1, the cleaning member 48 is put in the lock position P1, with the process cartridge 20 accommodated in the cartridge-accommodating section 32. To replace the toner cartridge 34, first the front cover 7 (FIG. 1) is opened, and then the process cartridge 20 is removed from the main casing 2 through the access opening 6. Next, the user grips the protruding part 66 and slides the cleaning member 48 from the lock position P1 to the release position P2. Through this operation, the cleaning member 48 cleans the surface of the charging wire 49 across nearly the entire length thereof. In addition, the fitting part 68 of the restricting member 67 separates from the groove 71, disengaging the restricting member 67 from the engaging part 70.

Next, as shown in FIG. 5, the user lifts the front end of the toner cartridge 34 so that the toner case 36 is sloped, causing the metal roller shaft 37A of the developing roller 37 to separate from the guide grooves 60. When the toner cartridge 34 is lifted farther, the toner cartridge 34 is detached from the cartridge frame 43. If the user attempts to remove the toner cartridge 34 while the cleaning member 48 is not in the release position P2 (that is, while the cleaning member 48 in the lock position P1 or in the intermediate position P3) (in other words, if the user has forgotten to move the cleaning member 48 from the lock position P1 to the release position P2), then the fitting part 68 of the restricting member 67 is still engaged in the engaging part 70, preventing the toner case 36 from being lifted to the sloped position shown in FIG. 5 and preventing the toner cartridge 34 from being removed.

Next, a new toner cartridge 34 is inserted at a slant with respect to the mounting section 51 of the cartridge frame 43, and the metal roller shaft 37A of the developing roller 37 is placed on the guide edges 61. The metal roller shaft 37A is slid rearward along the guide edges 61 and fitted into the guide grooves 60, so that the toner case 36 is mounted properly in the mounting section 51 and positioned with respect to the cartridge frame 43. Next, the user grips the protruding part 66 and slides the cleaning member 48 from the release position P2 to the lock position P1. Subsequently, the user inserts the process cartridge 20 into the cartridge-accommodating section 32 via the access opening 6 formed in the main casing 2. In this case, the guiding member 74 interferes almost not at all with the protruding part 66, and the process cartridge 20 can be inserted to the correct mounting position as is.

If the process cartridge 20 is inserted into the cartridge-accommodating section 32 while the cleaning member 48 is not in the lock position P1 (that is, while the cleaning member is in the release position P2 or in the intermediate position P3) (in other words, when the user has forgotten to move the cleaning member 48 from the release position P2 to the lock position P1 or when the user has moved the cleaning member 48 only part way), the protruding part 66 contacts the sloped part 74A of the guiding member 74 as the process cartridge 20 is being inserted, as indicated by the broken line with alternating dots and dashes in FIG. 6. As the process cartridge 20 is inserted toward the rear, the protruding part 66 is guided to the left along the sloped part 74A. When the protruding part 66 arrives at the left edge of the sloped part 74A, the cleaning member 48 is in the lock position P1. Subsequently, the right surface 66R of the protruding part 66 slides rearward along the parallel part 74B until the process cartridge 20 arrives in the proper mounting position (indicated by the solid lines in FIG. 6). If the guiding member 74 included only the sloped part 74A and not the parallel part 74B, then the protruding part 66 could catch on the left edge of the sloped part 74A when removing the process cartridge 20 if the process cartridge 20 has shifted within the cartridge-accommodating section 32 in the left-to-right direction after being mounted. However, by providing the guiding member 74 with the parallel part 74B, the protruding part 66 is reliably prevented from catching on the guiding member 74 when the process cartridge 20 shifts position.

In the illustrative aspects described above, ordinarily the cleaning member 48 is set to the lock position P1, locking the drum cartridge 35 and toner cartridge 34 together. When replacing the toner cartridge 34, the toner cartridge 34 and drum cartridge 35 are separated after moving the cleaning member 48 to the release position P2. If the cleaning member 48 is not moved from the lock position P1 to the release position P2, the toner cartridge 34 cannot be detached from the drum cartridge 35. Accordingly, the charging wire 49 is reliably cleaned each time the toner cartridge 34 is replaced.

When the cleaning member 48 is not in the release position P2 (when the cleaning member 48 is in the lock position P1 or in the intermediate position P3) the toner cartridge 34 is prevented from being detached from the drum cartridge 35 by the restricting member 67 engaged in the engaging part 70. Removal of the toner cartridge 34 is allowed when the cleaning member 48 is moved to the release position P2, thereby releasing this engagement. Accordingly, cleaning of the charging wire 49 can be reliably accomplished with a simple construction.

Further, since the fitting part 68 of the restricting member 67 is fitted into the groove 71 of the engaging part 70 when the cleaning member 48 is in the lock position P1 or in the intermediate position P3, it is difficult to disengage the restricting member 67 from the engaging part 70. Accordingly, this construction prevents the toner cartridge 34 from being mistakenly removed from the drum cartridge 35 when the cleaning member 48 is in the lock position P1 or in the intermediate position P3.

Further, by forming the fitting part 68 to bend in a direction B (FIG. 2) orthogonal to the extending direction of the restricting member 67 and the moving direction of the cleaning member 48, removal of the toner cartridge 34 is prevented. Accordingly, the restricting member 67 is not easily disengaged from the engaging part 70 when the cleaning member 48 is in the lock position P1 and in the intermediate position P3. Hence, the construction described above reliably prevents the toner cartridge 34 from being removed from the drum cartridge 35 when the cleaning member 48 is in the lock position P1 or in the intermediate position P3.

Though the input window 73 is provided between the path of the cleaning member 48 and the toner cartridge 34, the restricting member 67 does not block the input window 73 when the cleaning member 48 is in the lock position P1. Hence, the restricting member 67 does not obstruct image formation.

Further, by providing the protruding part 66 that protrudes from the outer side of the cleaning member 48 in a direction away from the drum cartridge 35, the user can easily move the cleaning member 48.

When the cleaning member 48 is in the release position P2 or in the intermediate position P3 when mounting the process cartridge 20, the cleaning member 48 is moved to the lock position P1 since the guiding member 74 guides the protruding part 66 as the process cartridge 20 is mounted. Accordingly, the cleaning member 48 can be returned to the lock position P1 without performing a special operation, thereby improving the convenience for the user.

Further, since the guiding member 74 is provided on the bottom wall 29A of the scanning unit 19 so as not to overlap the output window 30, the guiding member 74 does not obstruct the path of the laser beam during an exposing operation.

Figure 7:
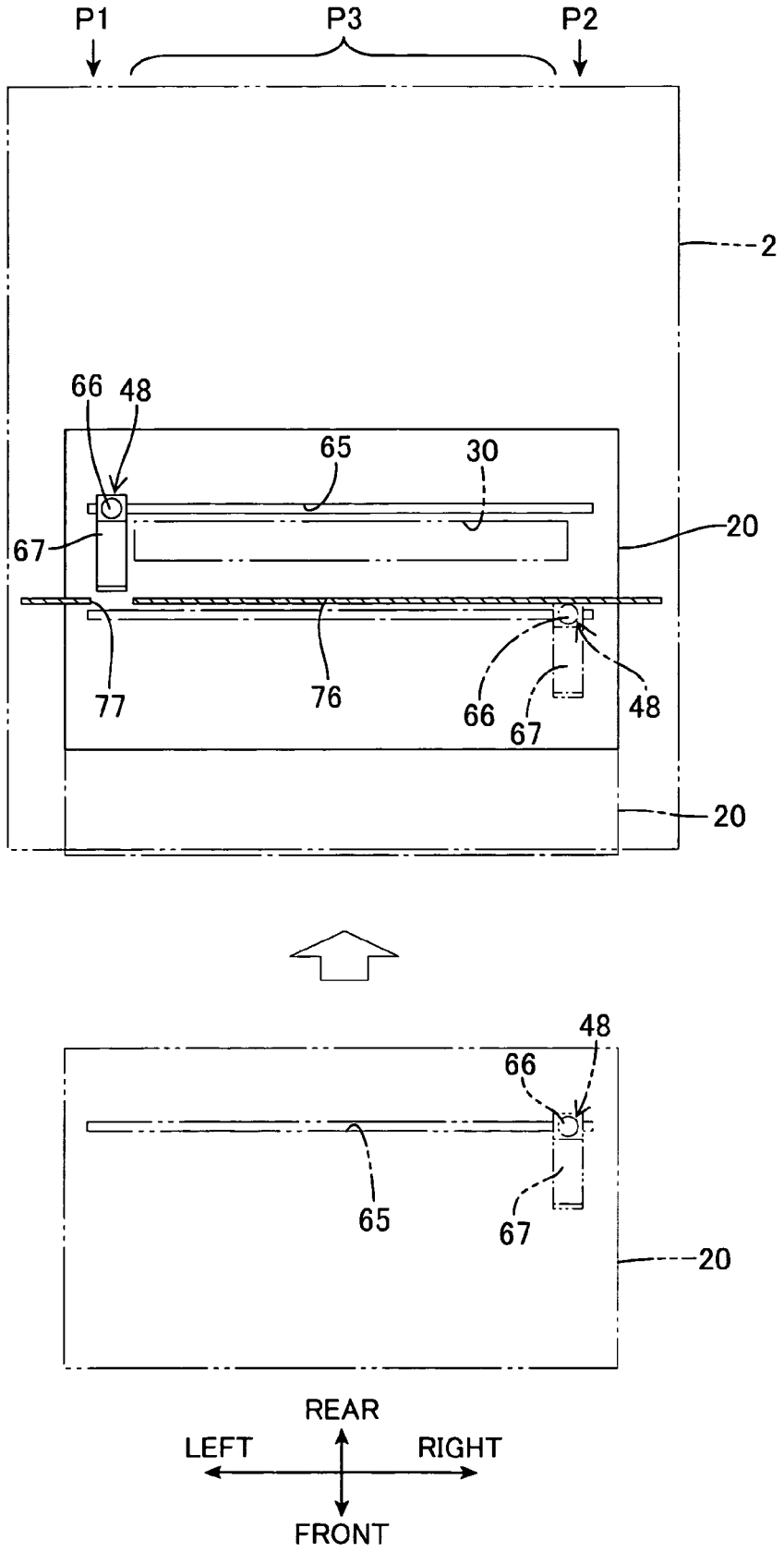
FIG. 7 is an explanatory diagram illustrating the function of an interference member for restricting insertion of the process cartridge.

Next, additional illustrative aspects of the invention will be described with reference to FIG. 7, wherein like parts and components are designated with the same reference numerals to avoid duplicating description. An interference member 76 is provided in place of the guiding member 74. The rest of the construction is identical to the illustrative aspects of the invention described above. FIG. 7 is an explanatory diagram illustrating the function of the interference member 76 for restricting the process cartridge 20 from being inserted into the cartridge-accommodating section 32.

The interference member 76 is formed on the bottom wall 29A of the scanner case 29 and extending in the left to right direction. The interference member 76 is positioned in front of the output window 30 so as not to obstruct the output window 30. An opening 77 is formed in the interference member 76 at a position corresponding to the protruding part 66 when the cleaning member 48 is in the lock position P1. If the protruding part 66 is in the lock position P1 when inserting the process cartridge 20 into the cartridge-accommodating section 32, the protruding part 66 passes through the opening 77, allowing the process cartridge 20 to be inserted into the proper mounting position, indicated by the solid line in FIG. 7, without being obstructed by the interference member 76. However, if the cleaning member 48 is in the release position P2 or in the intermediate position P3, the protruding part 66 contacts the interference member 76 when the process cartridge 20 is being inserted into the cartridge-accommodating section 32, preventing the process cartridge 20 from being inserted (indicated by the broken line of alternating dots and dashes in FIG. 7). Accordingly, after the user removes the process cartridge 20 from the cartridge-accommodating section 32, the user must move the protruding part 66 to the lock position P1 before reinserting the process cartridge 20.

In the additional illustrative aspects described above, the interference member 76 interferes with the protruding part 66 when mounting the process cartridge 20 if the cleaning member 48 is in the release position P2 or in the intermediate position P3, preventing the process cartridge 20 from being inserted. Accordingly, this construction reliably prevents the process cartridge 20 from being mounted if the user has forgotten to return the cleaning member 48 to the lock position P1.

Figure 8:
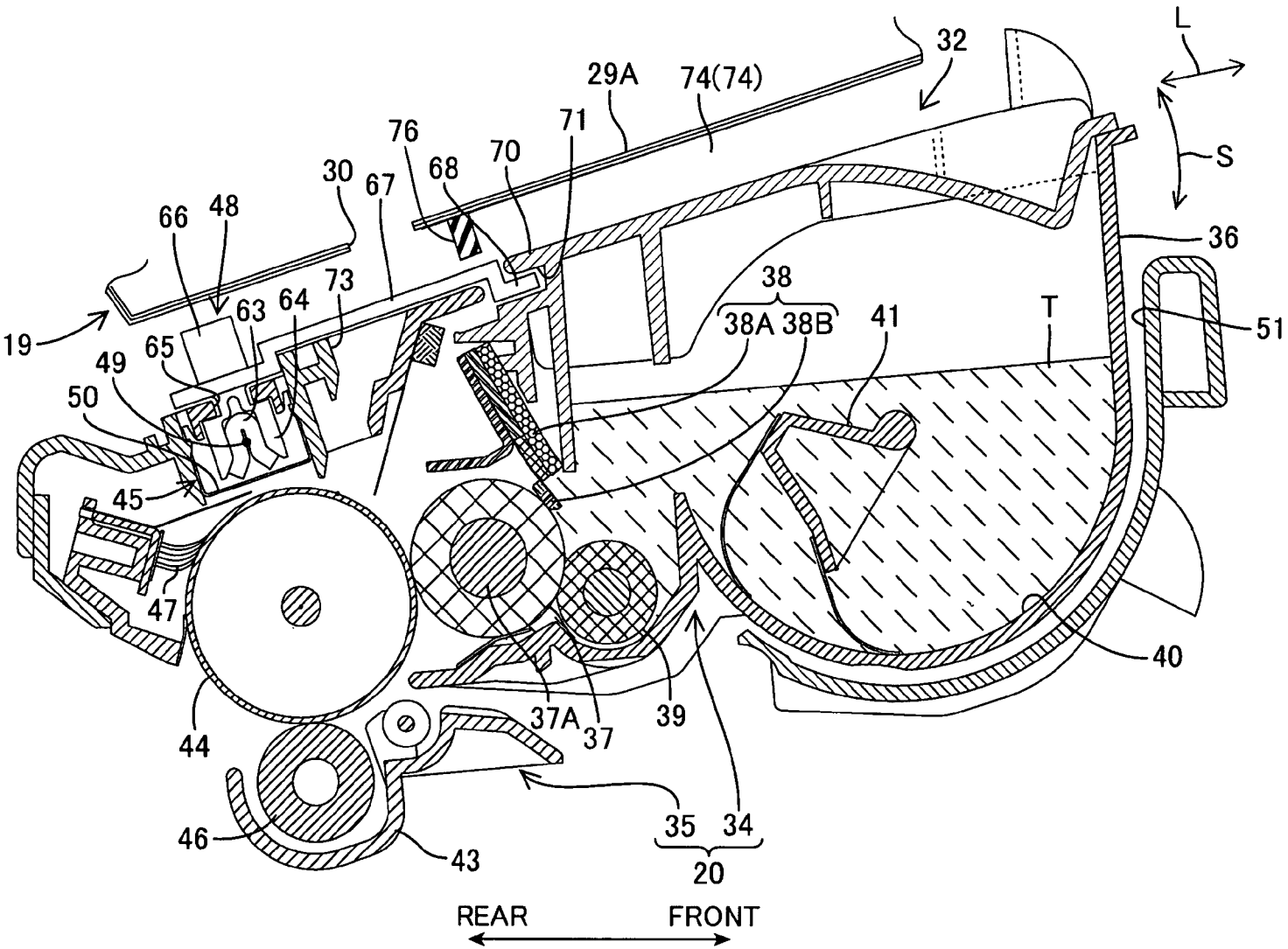
FIG. 8 is a side cross-sectional view showing a process cartridge mounted in the laser printer, and the bottom wall of a scanning unit according to additional illustrative aspects of the invention.

Further, as shown in FIG. 8, since the interference member 76 is provided on the bottom wall 29A of the scanning unit 19 so as not to overlap the output window 30, the interference member 76 does not obstruct the laser beam during an exposing operation.

Figure 9A:
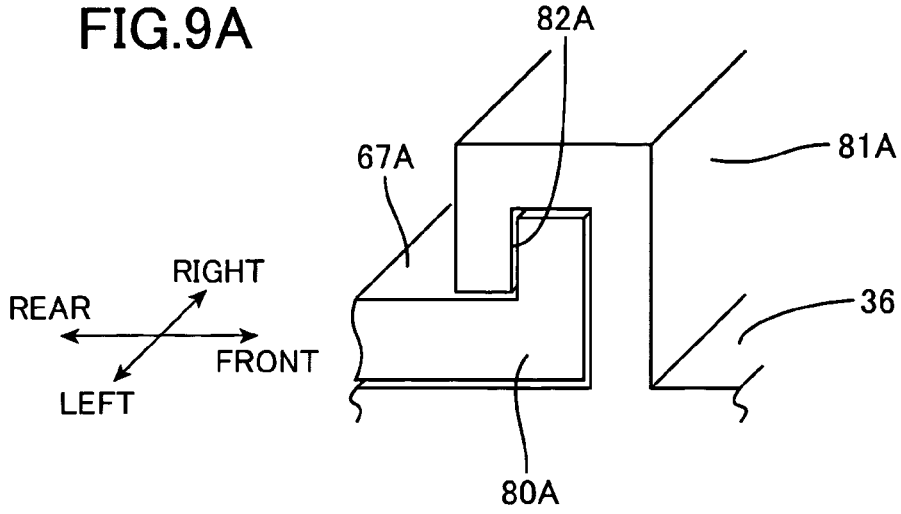
FIG. 9A is a partial enlarged perspective view illustrating a fitting part and a restriction part according to a first modification.
Figure 9B:
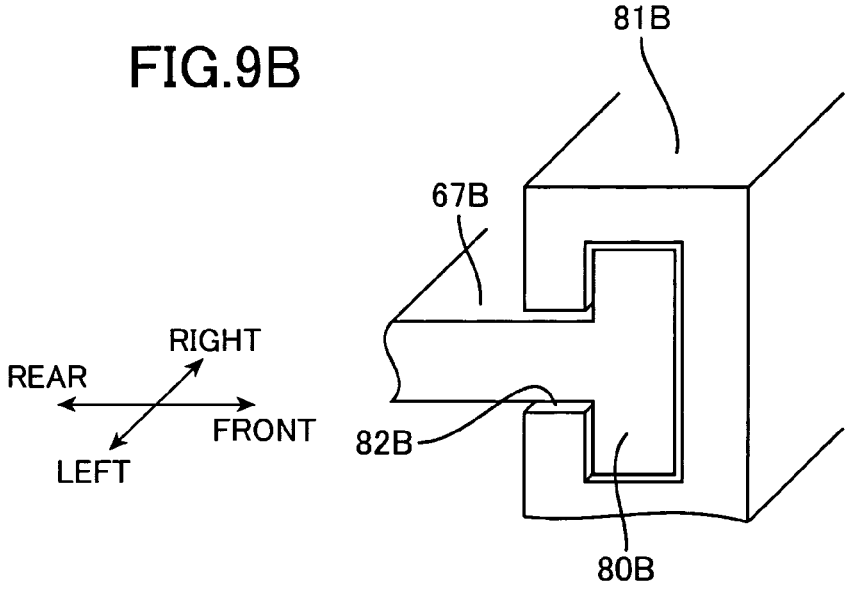
FIG. 9B is a partial enlarged perspective view illustrating a fitting part and a restriction part according to a second modification.
Figure 9C:
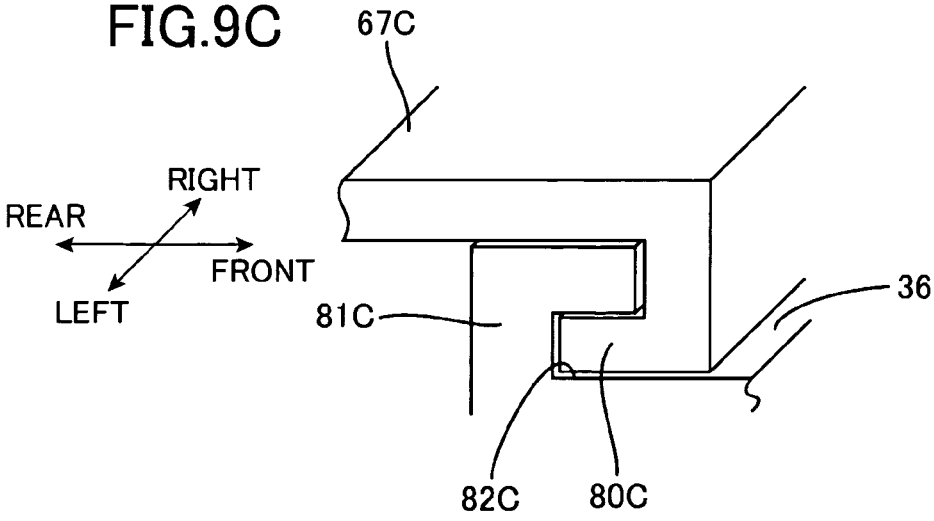
FIG. 9C is a partial enlarged perspective view illustrating a fitting part and a restriction part according to a third modification.

FIGS. 9A through 9C are partial, enlarged perspective views showing modifications of the fitting part provided on the end of the restricting member and the engaging part provided on the toner case.

FIG. 9A shows a fitting part 80A formed with a L-shaped cross section according to a first modification. Specifically, the fitting part 80A continues in the extending direction of a restricting member 67A (front-to-rear direction) and bends in a direction orthogonal to the extending direction and to the direction in which the cleaning member 48 moves (left-to-right direction). A restriction part 81A extends upward from the upper rear edge of the toner case 36, bends toward the rear (left in the drawing), and bends again downward. A groove 82A is formed along the moving direction of the cleaning member 48 (along the left-to-right direction) inside this restriction part 81A. The fitting part 80A can fit into the groove 82A.

FIG. 9B shows a fitting part 80B that has a T-shaped cross section according to a second modification. Specifically, the fitting part 80B bends both upward and downward in directions orthogonal to the extending direction of a restricting member 67B (front-to-rear direction) and orthogonal to the moving direction of the cleaning member 48 (left-to-right direction). A restriction part 81B has a C-shaped cross section that opens toward the rear (left in the drawing). A groove 82B in which the fitting part 80B can be fitted is formed in this restriction part 81B along the moving direction of the cleaning member 48 (left-to-right direction).

FIG. 9C shows a fitting part 80C having a L-shaped cross section according to a third modification. Specifically, the fitting part 80C bends downward from the front edge of a restricting member 67C and bends again rearward from the bottom edge thereof. A restriction part 81C also has an L-shaped cross section, extending upward from the upper rear edge of the toner case 36 and bending forward from the upper edge thereof. A groove 82C in which the fitting part 80C can be fitted is formed inside the restriction part 81C and along the moving direction of the cleaning member 48 (left-to-right direction).

As in the illustrative aspects of the invention, a cutout part is provided on the right edge of each restriction part 81A-81C described above. When the cleaning member 48 is in the release position P2, the fitting part 80A-80C separates from the respective groove 82A-82C, disengaging the restricting member 67A-67C from the respective restriction part 81A-81C.

In the modifications described above, the fitting parts 80A-80C are bent in a direction orthogonal to the extending direction of the restricting member 67A-67C and the moving direction of the cleaning member 48, restricting the removal of the toner cartridge 34. Accordingly, if the user attempts to detach the toner cartridge 34 while the cleaning member 48 is in the lock position P1 or in the intermediate position P3, the fitting parts 80A-80C press strongly against the inner surfaces of the respective groove 82A-82C according to the principle of leverage, making it difficult to release the engagement between the respective restricting member 67A-67C and the respective restriction part 81A-81C. Hence, the construction of the modifications described above reliably prevents the toner cartridge 34 from being removed from the drum cartridge 35 when the cleaning member 48 is in the lock position P1 and in the intermediate position P3.

While the invention has been described in detail with reference to the illustrative aspects thereof, it would be apparent to those skilled in the art that various changes and modifications may be made therein without departing from the spirit of the invention.

For example, in the illustrative aspects of the invention described above, the protruding part 66 is provided integrally on the cleaning member 48. However, the protruding part may instead be provided on the restricting member 67 (removal-restricting portion).

What is claimed is:

1. A process cartridge comprising:

an image-bearing member cartridge comprising:

an image-bearing member that extends in an axial direction for bearing a developer image;

a charger disposed adjacent to the image-bearing member, the charger having a charging wire that extends in the axial direction and that has one end and another end, the charger being configured to charge the image-bearing member when a voltage is applied to the charging wire;

a cleaning member movable in the axial direction along the charging wire for cleaning the charging wire, the cleaning member being movable between a first position located on the one end and a second position located on the another end; and a removal-restricting portion movable together with the cleaning member between the first position and the second position; and a developer cartridge detachably mounted on the image-bearing member cartridge and accommodating developer for supplying the image-bearing member with the developer, wherein the removal-restricting portion directly prevents the developer cartridge from being removed from the image-bearing member cartridge when the cleaning member is in the first position, and directly allows the developer cartridge to be removed from the image-bearing member cartridge when the cleaning member is in the second position.

2. The process cartridge as claimed in claim 1, wherein the removal-restricting portion comprises a restricting member extending in an extending direction from the cleaning member toward the developer cartridge, the restricting member being movable together with the cleaning member; and wherein the developer cartridge comprises an engaging part that engages with the restricting member for preventing the developer cartridge from being removed from the image-bearing member cartridge when the cleaning member is in a position other the second position, and that is disengaged from the restricting member for allowing the developer cartridge to be removed from the image-bearing member cartridge when the cleaning member is in the second position.

3. The process cartridge as claimed in claim 2, wherein the engaging part has a groove extending in the axial direction; and wherein the restricting member comprises a fitting part that fits inside the groove when the cleaning member is in the first position, and that separates from the groove when the cleaning member is in the second position.

4. The process cartridge as claimed in claim 3, wherein the fitting part has a bending part that bends in a direction orthogonal both to the axial direction and to the extending direction, thereby preventing the developer cartridge from being removed from the image-bearing member cartridge.

5. The process cartridge as claimed in claim 2, wherein the image-bearing member cartridge further has an input window extending in the axial direction for allowing passage of a light beam to expose the image-bearing member, the input window being located between a moving path of the cleaning member and the developer cartridge; and wherein the restricting member is located at a position outside the input window with respect to the axial direction when the cleaning member is in the first position.

6. The process cartridge as claimed in claim 1, wherein at least one of the cleaning member and the removal-restricting portion comprises a protruding part that protrudes in a direction away from the image-bearing member cartridge, thereby allowing the cleaning member to be movably operated.

7. An image-bearing member cartridge configured to detachably mount a developer cartridge which accommodates developer, the image-bearing member cartridge comprising:

an image-bearing member that extends in an axial direction for bearing a developer image;

a charger disposed adjacent to the image-bearing member, the charger having a charging wire that extends in the axial direction and that has one end and another end, the charger being configured to charge the image-bearing member when a voltage is applied to the charging wire;

a cleaning member movable in the axial direction along the charging wire for cleaning the charging wire, the cleaning member being movable between a first position located on the one end and a second position located on the another end; and a removal-restricting portion movable together with the cleaning member between the first position and the second position, wherein the removal-restricting portion directly prevents the developer cartridge from being removed from the image-bearing member cartridge when the cleaning member is in the first position, and directly allows the developer cartridge to be removed from the image-bearing member cartridge when the cleaning member is in the second position.

8. The image-bearing member cartridge as claimed in claim 7, wherein the removal-restricting portion comprises a restricting member extending in an extending direction from the cleaning member toward a mounting section for mounting the developer cartridge, the restricting member being movable together with the cleaning member; and wherein, when the developer cartridge is mounted on the image-bearing member cartridge, the restricting member engages with an engaging part formed in the developer cartridge for preventing the developer cartridge from being removed from the image-bearing member cartridge when the cleaning member is in a position other than the second position, and the restricting member is disengaged from the engaging part for allowing the developer cartridge to be removed from the image-bearing member cartridge when the cleaning member is in the second position.

9. The image-bearing member cartridge as claimed in claim 8, wherein the restricting member comprises a fitting part; and wherein, when the developer cartridge is mounted on the image-bearing member cartridge, the restricting member fits inside a groove formed in the engaging part when the cleaning member is in the first position, and that separates from the groove when the cleaning member is in the second position.

10. The image-bearing member cartridge as claimed in claim 9, wherein the fitting part has a bending part that bends in a direction orthogonal both to the axial direction and to the extending direction, thereby preventing the developer cartridge from being removed from the image-bearing member cartridge.

11. The image-bearing member cartridge as claimed in claim 8, further including an input window extending in the axial direction for allowing passage of a light beam to expose the image-bearing member, the input window being located between a moving path of the cleaning member and the developer cartridge when the developer cartridge is mounted on the image-bearing member cartridge, wherein the restricting member is located at a position outside the input window with respect to the axial direction when the cleaning member is in the first position.

12. The image-bearing member cartridge as claimed in claim 7, wherein at least one of the cleaning member and the removal-restricting portion comprises a protruding part that protrudes in a direction away from the image-bearing member cartridge, thereby allowing the cleaning member to be movably operated.

13. A developer cartridge detachably mountable on an image-bearing member cartridge and accommodating developer, the image-bearing member cartridge including:

an image-bearing member that extends in an axial direction for bearing a developer image;

a charger disposed adjacent to the image-bearing member, charger having a charging wire that extends in the axial direction and that has one end and another end, the charger being configured to charge the image-bearing member when a voltage is applied to the charging wire;

a cleaning member movable in the axial direction along the charging wire for cleaning the charging wire, the cleaning member being movable between a first position located on the one end and a second position located on the another end; and a removal-restricting portion movable together with the cleaning member between the first position and the second position, the removal-restricting portion including:

a restricting member extending in an extending direction from the cleaning member toward a mounting section for mounting the developer cartridge, the restricting member being movable together with the cleaning member, the developer cartridge comprising:

an engaging part that engages with the restricting member for directly preventing the developer cartridge from being removed from the image-bearing member cartridge when the cleaning member is in a position other than the second position, and that is disengaged from the restricting member for directly allowing the developer cartridge to be removed from the image-bearing member cartridge when the cleaning member is in the second position.

14. The developer cartridge as claimed in claim 13, wherein the engaging part is formed with a groove extending in the axial direction, a part of the restricting member being configured to fit in the engaging part; and wherein the restricting member separates from the groove when the cleaning member is in the second position.

* * * * *